US005655979A

United States Patent [19]

Blue

[11] Patent Number: 5,655,979

[45] Date of Patent: Aug. 12, 1997

[54] TABLE TENNIS STYLE GAME WITH BASKETBALL BACKBOARDS, HOOPS, NETS AND FOAM BALL

[76] Inventor: John D. Blue, P.O. Box 1992, Tarpon Springs, Fla. 34688-1992

[21] Appl. No.: 666,933

[22] Filed: Jun. 20, 1996

[51] Int. Cl.[6] ..... A63B 67/04

[52] U.S. Cl. ..... 473/475

[58] Field of Search ..... 273/30; 473/474–475, 473/447, 469, 472

[56] References Cited

U.S. PATENT DOCUMENTS

| | | | |
|---|---|---|---|
| 755,936 | 3/1904 | Ricau | 273/30 |
| 1,116,459 | 11/1914 | McDonald | 273/30 |
| 2,051,476 | 8/1936 | Grant | 273/30 |
| 2,313,701 | 3/1943 | White | 273/30 |
| 3,001,791 | 9/1961 | Atwood | 273/30 |
| 3,622,156 | 11/1971 | Pugsley . | |
| 3,697,068 | 10/1972 | McDougall . | |
| 3,814,422 | 6/1974 | Girden . | |
| 3,819,182 | 6/1974 | Lersch . | |
| 4,034,978 | 7/1977 | Becker | 273/30 |
| 4,134,585 | 1/1979 | Semon . | |
| 5,178,385 | 1/1993 | Barbador | 273/30 |
| 5,398,926 | 3/1995 | Skinner . | |
| 5,460,365 | 10/1995 | Payne | 273/30 |
| 5,470,057 | 11/1995 | Bodford | 273/30 |

FOREIGN PATENT DOCUMENTS

| | | | |
|---|---|---|---|
| 4551 | of 1901 | United Kingdom | 273/30 |
| 2516 | of 1902 | United Kingdom | 273/30 |
| 203516 | 9/1923 | United Kingdom | 273/30 |

OTHER PUBLICATIONS

"Unique Sales Co." 1968.

*Primary Examiner*—Theatrice Brown

[57] ABSTRACT

A side basketball style backboard with attached hoop and net assembly is herein designed for mounting on both sides of a table tennis style table. The backboard has an upper surface area that can be used to deflect the game ball into the opposing playing area. The backboard is secured to the table by a bracket with screws or bolts as an attachment means. The upper end of the bracket attaches to the backside of the backboard and the lower end of the bracket attaches to the outside edge and the underside of the table. The game ball is made of foam and the ball striking instrument can be selected from a paddle, a racquet with strings or foam mitts with one on each hand.

8 Claims, 8 Drawing Sheets

LEFT HAND MITT

RIGHT HAND MITT

TABLE TENNIS STYLE GAME WITH BASKETBALL BACKBOARDS, HOOPS, NETS AND FOAM BALL

BACKGROUND OF THE INVENTION (1) Field of the Invention

The general field of the present invention is a recreation game played on a table tennis style table with basketball style backboards, hoops and nets.

The game of table tennis is familiar to all. The game includes a table, a vertical net and opposing playing areas. Two or more players volley a plastic ball across the net with wooden paddles until a point is scored.

(2) Description of the Prior Art

The table used in table tennis is rectangular in shape and has a net which seperates the table into two equal size playing areas. Each playing area is divided into two serving areas.

There has been numerous additions to the common table tennis table as seen in the following prior art patents.

In U.S. Pat. No. 5,460,365 Payne teaches table tennis side rebound panels on opposing sides. In the game of table tennis the players can play the game ball off the rebound panels into their opponents playing area. The invention has no basketball hoops with nets.

In U.S. Pat. No. 5,398,926 Skinner teaches a game accelerating table tennis table top. This game teaches a deflection bias to a ball with no rebound side panels.

In U.S. Pat. No. 4,134,585 Semon teaches a return board for single end table tennis. No side panels nor hoops with nets are shown.

In U.S. Pat. No. 3,819,182 Lersch teaches two barriers mounted on a table tennis table. This game does teach a foam ball, but has no side rebound panels.

In U.S. Pat. No. 3,814,422 Girden teaches a free standing rebound backboard which is placed at one end of the table. The game has no side panels.

In U.S. Pat. No. 3,697,068 McDougall reveals a rebound wall for games such as tennis or the like.

In U.S. Pat. No. 3,622,156 Pugsley teaches a game table formed of two surfaces seperated from each other providing an open space therebetween.

The aforementioned cited prior art patents all teach a recreation game apparatus. Some teach table tennis style tables with additional rebound panels. The cited patents all leave room for a new and novel recreation table tennis style game.

The primary object of the present invention is to provide an improved game apparatus using a standard table tennis table with a standard net thereon. Introduced at this stage are; two basketball style backboards; two basketball style hoops with attached nets and a foam ball with three holes therethrough.

Another object of the game is to introduce the backboards as a means of deflecting the game ball off the boards into the opposite playing area. This increases the game difficulty.

Yet another object of the game is to introduce the backboards with the hoops and nets as a means of scoring points.

Yet another object of the game is to, provide a kit for the consumer which can simply be added onto their present table tennis table at home. The professional model will be placed in recreation centers and they can book court time and play for competition such as racquetball.

The balance of the features and advantages of the present invention will be apparent during the course of the following drawings and preferred embodiment description.

DETAILED DESCRIPTION OF THE PREFERRED EMBODIMENT

Figure 1:
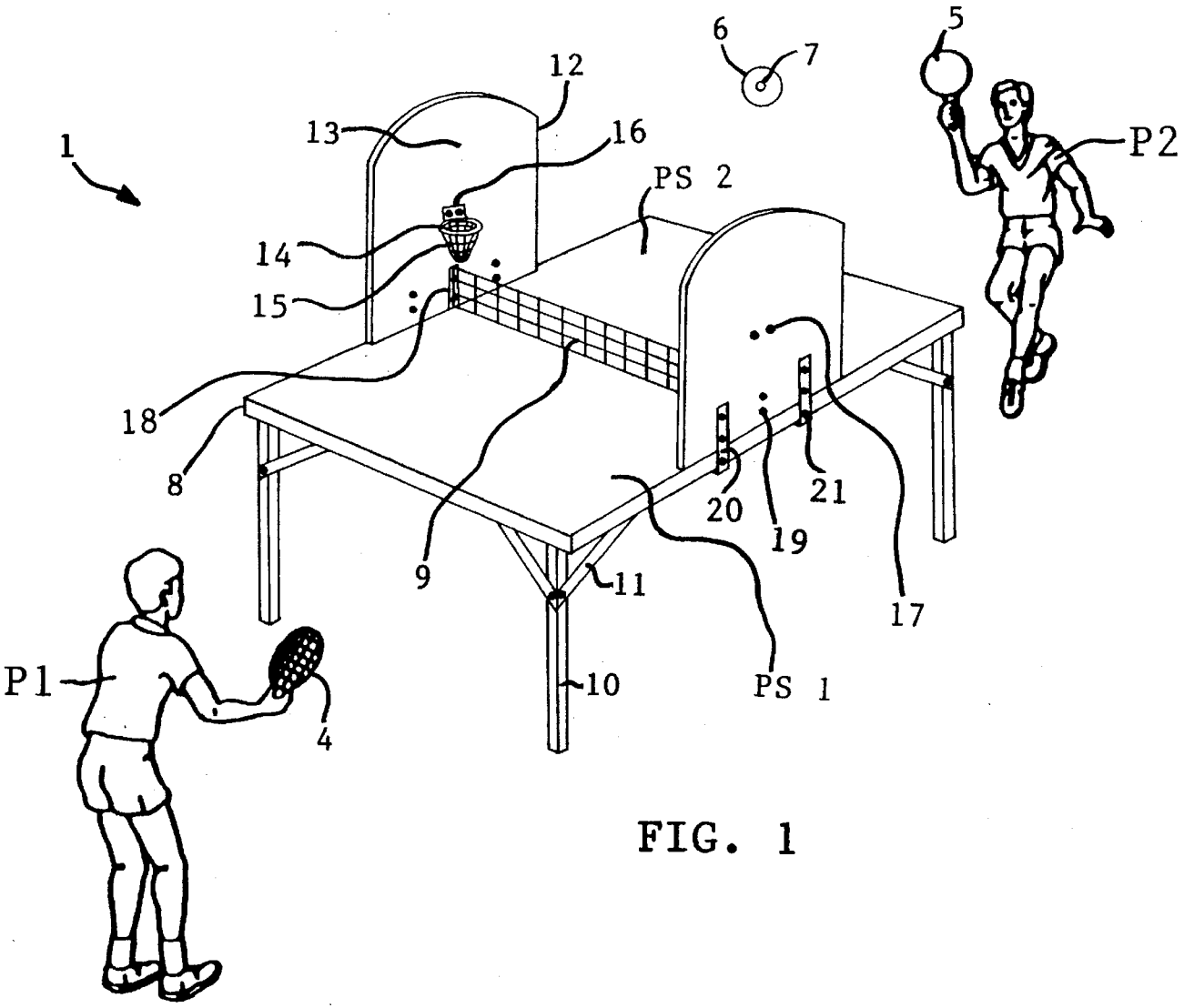
FIG. 1 is a pictorial perspective view of the game of the invention.

Referring now to the drawings, and especially to FIG. 1 thereof, a game of the invention is illustrated generally at 1 and is shown played between two opposed players P1 and P2 on a table 8 of prescribed configuration and measurements in line with a standard recognized table tennis table. Table 8 has horizontal playing surfaces PS1 and PS2. Each player is holding a ball striking instrument. P1 holds a racquet 4 and P2 holds a paddle 5. One player hits foam game ball 6 with holes 7 therethrough across the virtical net 9 onto opposing playing surface and the opposing player returns the game ball 6. This starts the game volley.

Table 8 has four legs 10 which support table 8. Braces 11 allow the table 8 to be stable and also allow the table 8 to be folded for moving purposes. Placed on table 8 are opposing basketball style backboards; 12 with deflective surfaces 13 which are supported by table 8 and secured in place by support brackets 20 by attachment means screws/bolts 21. The virtical net 9 is attached to the lower center portion of backboards 12 with brackets 18 so that the virtical game net 9 seperates the playing surfaces PS1 and PS2 into two equal size areas.

Attached to backboards 12 are opposing basketball style hoops 14 with attached nets 15 The hoop 14 net 15 are attached to the opposing backboards with hoop support brackets 16 by hoop attachment means 17 either screws or bolts.

Player P1 bounces the foam game ball 6 with holes 7 on his/her playing surface PS1 and hits the ball 6 with the selected ball striking instrument a racquet 4, a paddle 5 or a pair of foam mitts. The mitts are not shown in FIG. 1. The ball 6 must cross over the vertical net 9 and bounce onto the opposing playing surface area PS2. The opposing player may return ball 8 across net 9 and volley thereafter. At any given time the ball 6 may only bounce one time. Once missed or driven off the table 8 out of the reach of either player, a point is scored.

A further point may be gained when either player P1 or P2 hits the ball 6 into either opposing hoop 14 net 15 assembly. The upper backboard surface 13 may be used so as to deflect the ball 6 off the backboard and into the opposing playing area. This angle creates a degree of difficulty inherent within the present invention.

Table tennis has similiar rules and regulations. Table top air ball, the present invention, follows these basic rules while taking the game to new levels of interest. The foam ball is soft, light and of a size of between 2" to 4" in diameter so as to make the game slower than table tennis.

Volley's and misses create one point thereof. The basketball style hoop and net assemblies yield two points. The ball can bounce off the backboard surface and into the hoop/net assembly or be hit directly into the hoop/net assembly.

The game may be played by two players, one on one or doubles with two on two. At no time can any player grab and dunk the game ball 6.

The game ball 6 of the present invention is made of a spherical aerodynamic designed shape. A plurality of holes 7 are cut by punching or drilling into and throughout the ball 6, from one surface to the opposite surface, as shown in more detail in FIG. 8. The preferred combination is three identical sized holes 7 geographically located at equal starting entrance positions while passing entirely through ball 6 to an exit point on the opposite surface. Each ball 6 is preferred round in shape.

The amount of the foam ball 6 material removed may range from 10% to 50% by weight volume. Prefer is approximately 20% by weight/volume removed from the ball 6. If any less, the ball 6 has less air drag. If any more, the ball 6 will collarse, making the ball unplayable. Twenty percent removed yields a stable ball 6 with just enough air drag and bounce to limit the distance for playabilty in the game 1 of the present invention.

The ball 6 is manufactured from a polyurethane open cell foam. Preferred is polyether which passes the U.S.A. Federal Safe Toy Act.

The preferred ball 6 diameter is two inches. The right size to handle with standard size table tennis paddles while fitting through most basketball hoop/rim assemblies. The pore size of the foam ball 6 may range from 10–100 p.p.i.'s (pores per inch). Preferred is approximately 50 p.p.i.'s. The color of ball 6 may range from a spectrum from white to black.

Figure 2:
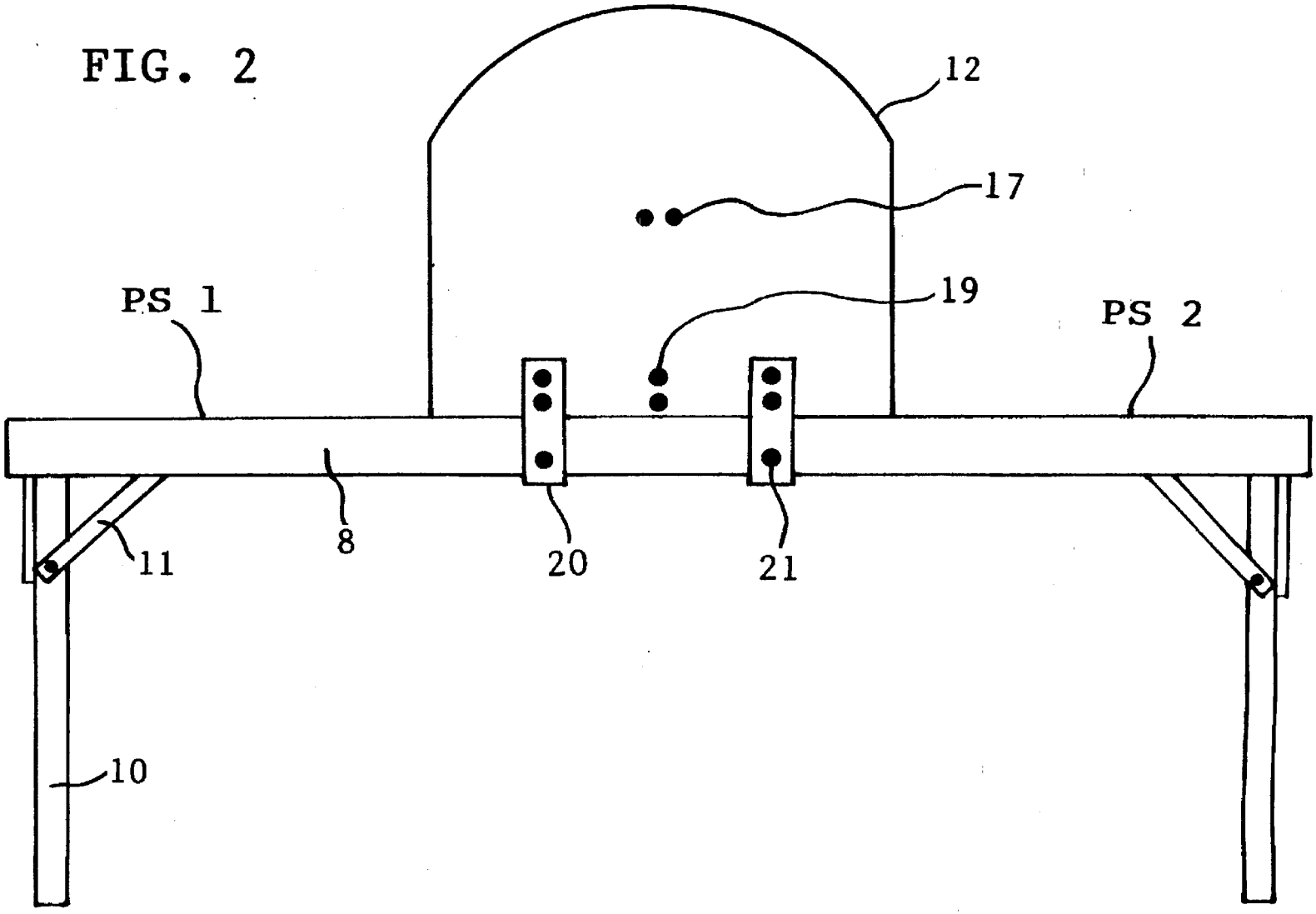
FIG. 2 is an outside side view of one side of the invention; the opposite outside side view being the mirror image thereof.

In FIG. 2 the table 8 is shown with legs 10 with braces 11 with opposing surface areas PS1 and PS2. Set on top of table 8 playing surface areas PS1 and PS2 is the outside view of backboard 12 with hoop attachment means 17 and game virtical net attachment means 19. Backboard 12 is supported by brackets 20 with attachment means 21 to table 8.

Figure 3:
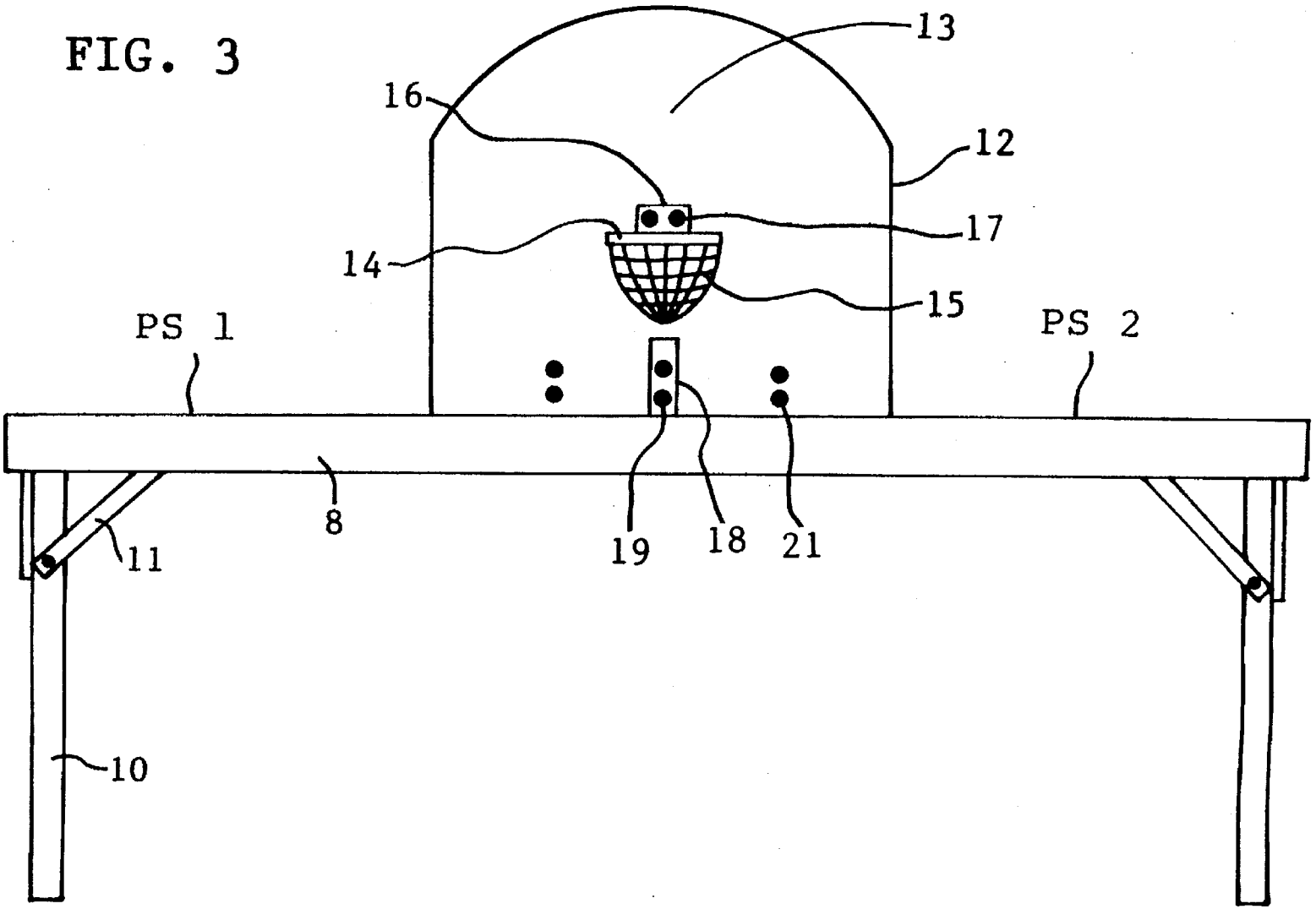
FIG. 3 is an inside side view of one side of the invention; the opposite inside side view being the mirror image thereof.

In FIG. 3 the table 8 is shown with legs 10 with braces 11 with opposing playing surface areas PS1 and PS2 Set on top of table 8 playing surface areas PS1 and PS2 is the inside view of backboard 12 with deflective surface 10; hoop support bracket 16 with attachment means 17; hoop 14 with attached net 15. At the base of backboard 12 is the game net support bracket 18 with attachment means 19. Backboard support bracket attachment means 21 is shown one oh both sides of net support bracket 18.

Figure 4:
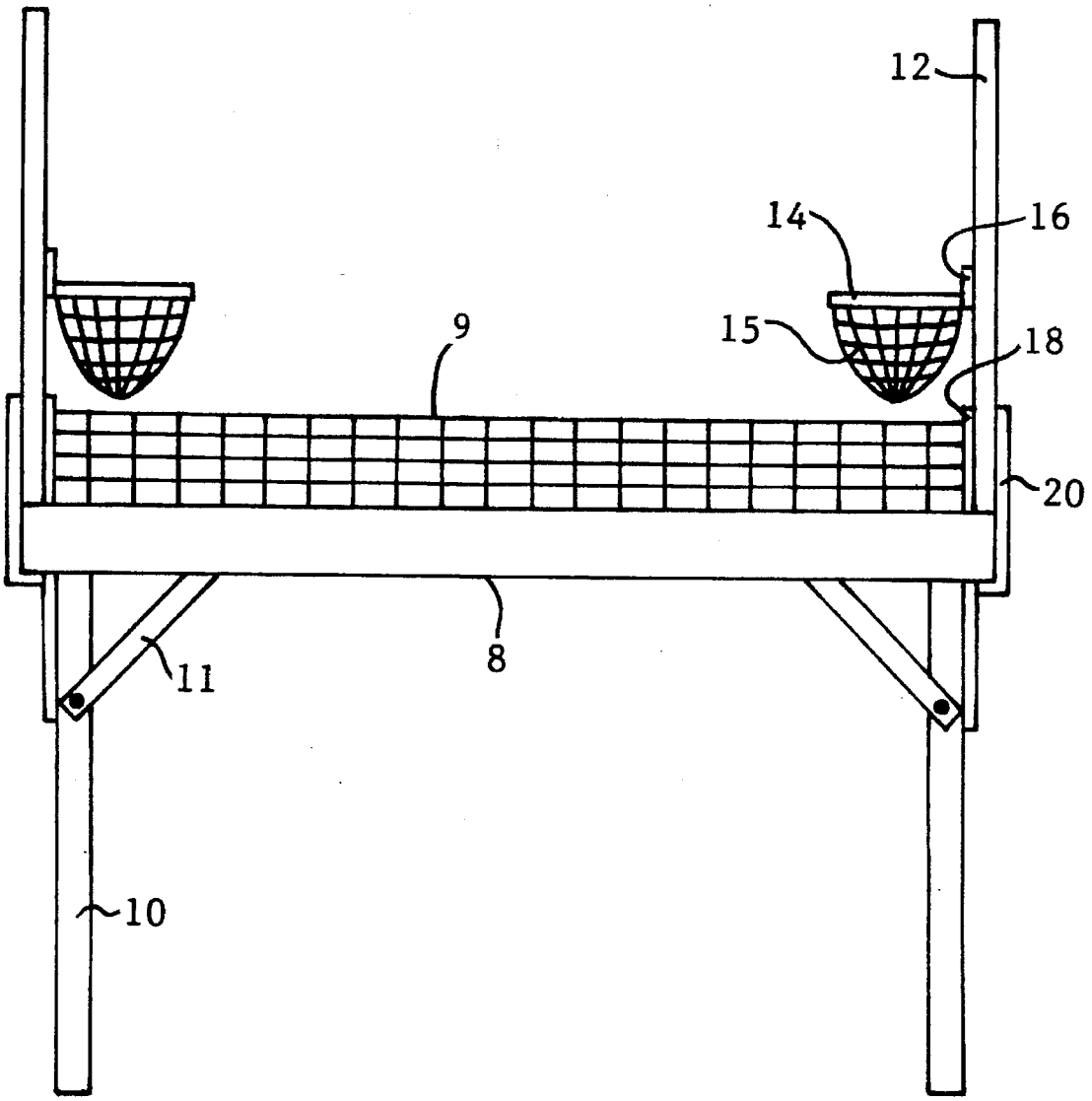
FIG. 4 is an end view of the game, of the invention; the opposite end view being the mirror image thereof.

FIG. 4 is an end view of table 8 with legs 10 and braces 11. Supported by table 8 are opposing backboards 12 with support brackets 20. On each opposing backboard 12 are hoop support brackets 16 with hoops 14 and attached nets 15. Virtical net 9 is attached to both opposing backboards 12 by support brackets 18. The opposite end is the mirror image.

Figure 5:
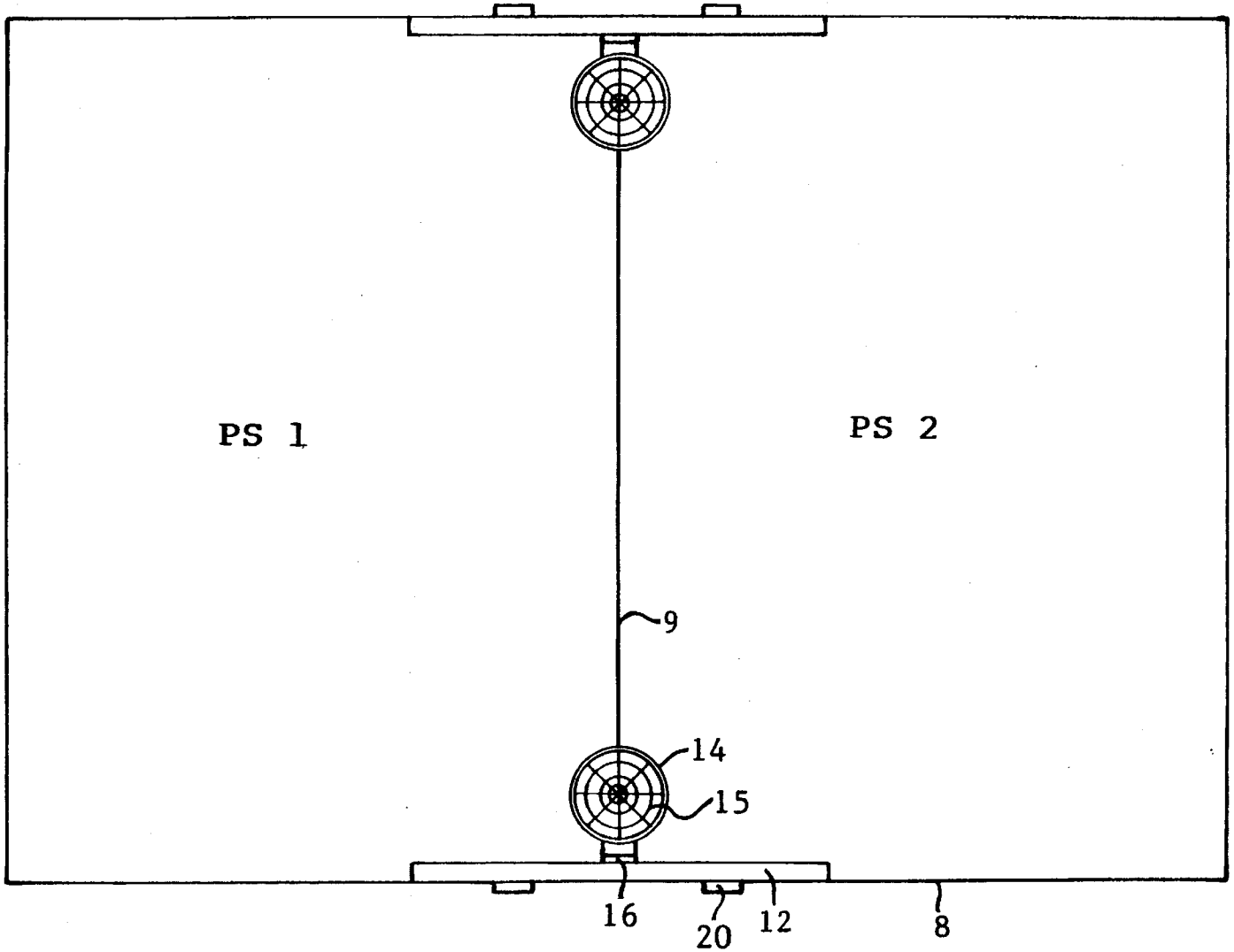
FIG. 5 is a top flat view of the game of the invention.

In FIG. 5 the table 8 is shown in a top flat plan with playing surfaces PS1 and PS2 seperated by game net 9. On opposing sides of table 8 are opposing backboards 12 supported by brackets 20. Attached to the inside of opposing backboards 12 are hoops 14 with attached nets 15. The hoops 14 and nets 15 are attached to backboards 12 by hoop support brackets 16.

Figure 6:
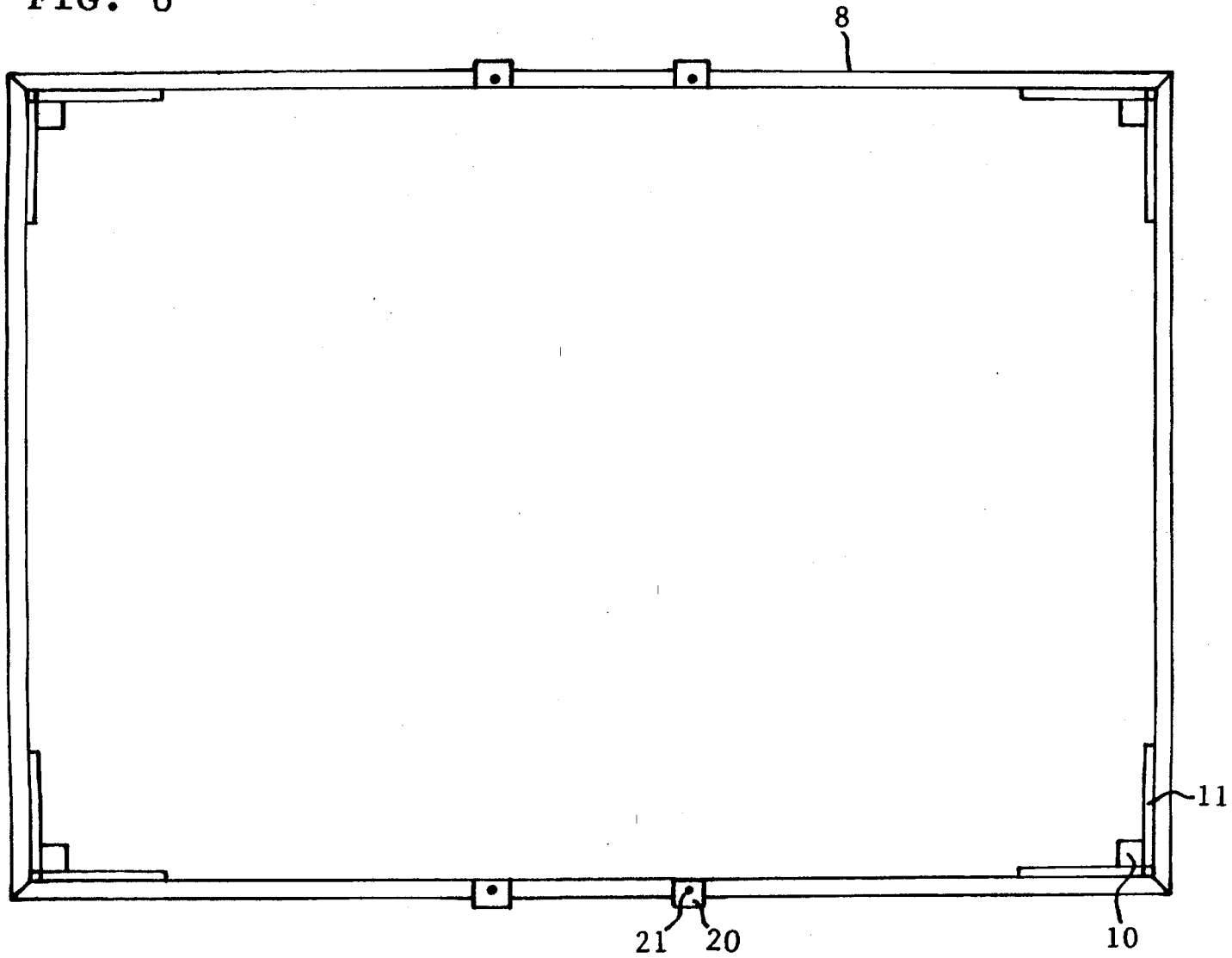
FIG. 6 is a bottom flat view of the game of the invention.

In FIG. 6 the table 8 is shown in a bottom flat plan with opposing backboard support brackets 20 with attachment means 21. In each corner of table 8 are legs 10 with braces 11.

Figure 7A:
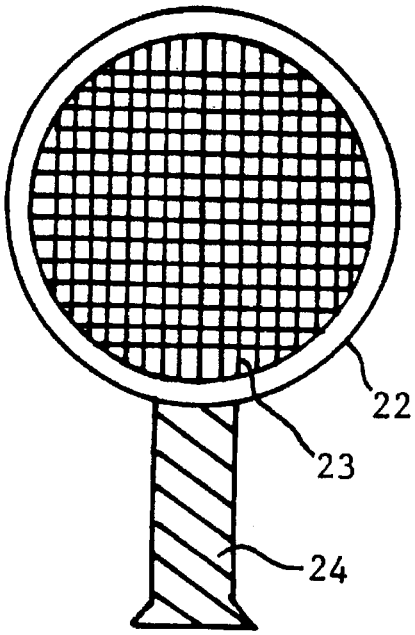
FIG. 7 is a flat view of the ball striking instruments; (A) a racquet; (B) a paddle; (C) a pair of foam mitts.
Figure 7B:
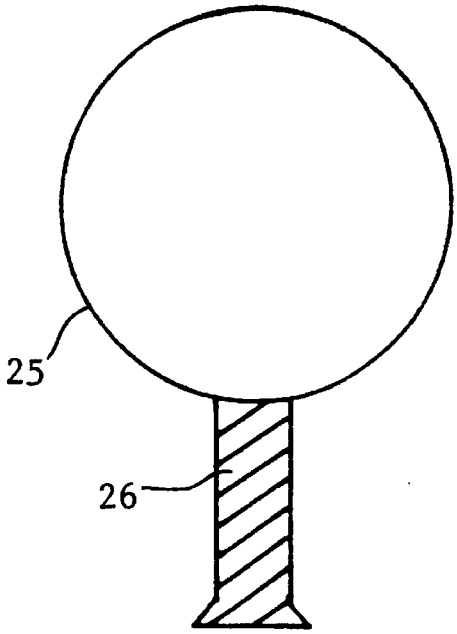
Figure 7C:
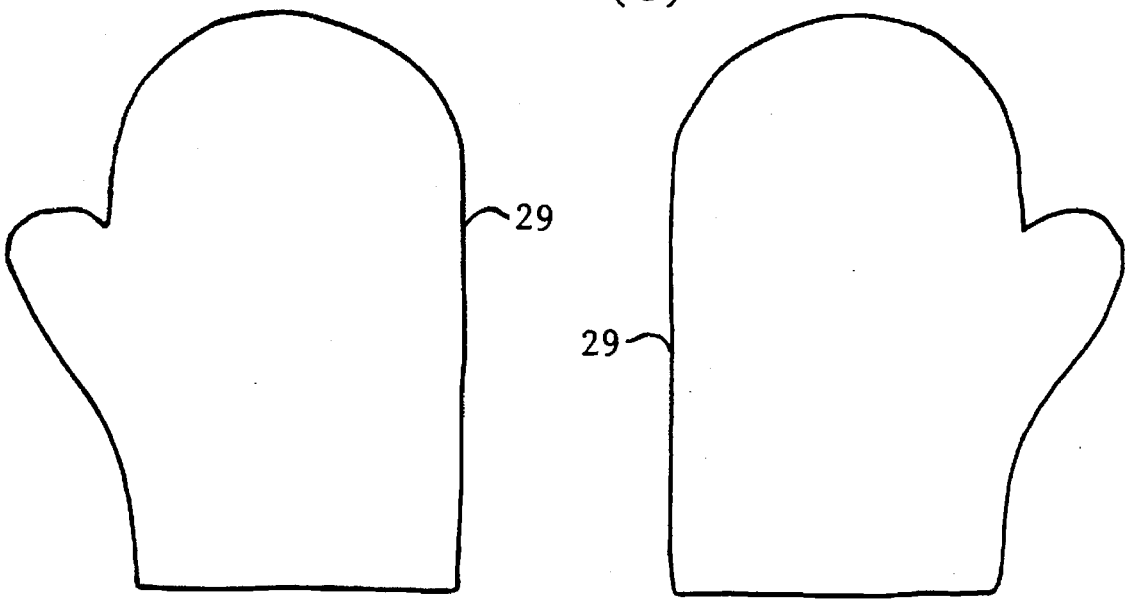

In FIG. 7 the selection of ball striking instruments are shown as follows;

(A) a racquet 22 with strings 23 and handle 24;

(B) a paddle 25 with handle 26;

(C) a pair of foam mitts 29.

In the case of the wood paddles, ordinary table tennis paddles may be used. In the case of the mitts; one is supplied for each hand. The foam is of polyester which has and upper and lower layer which are pressed together and then heat sealed and dye cut so as to form one mitt.

Figure 8A:
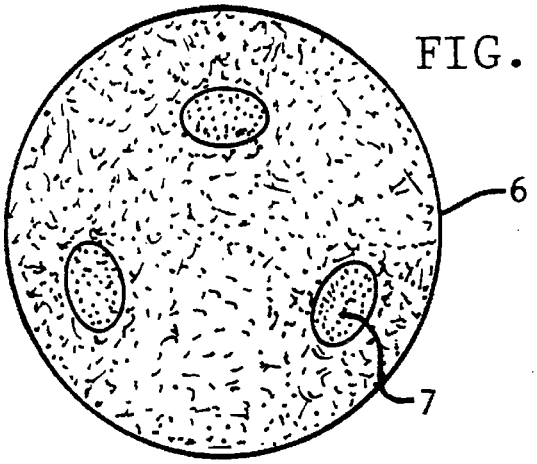
FIG. 8 is a view of the ball of the game of the invention as follows; (A) a perspective view; (B) a view of one side; (C) a cross sectional view.
Figure 8B:
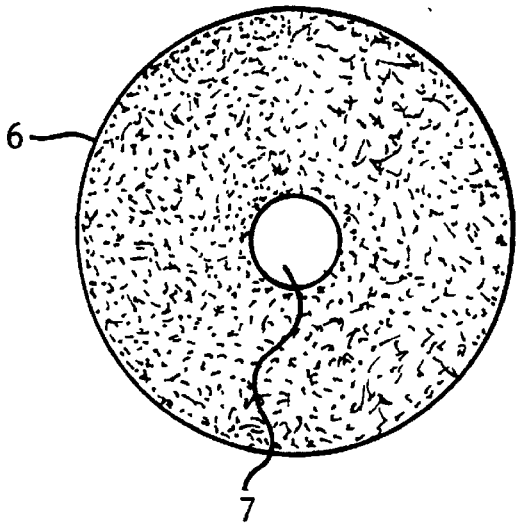
Figure 8C:
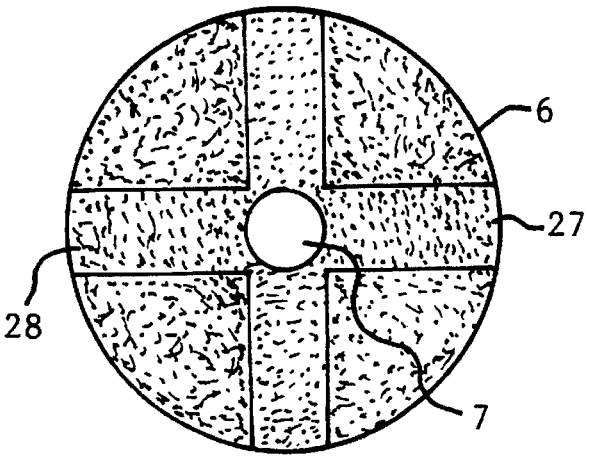

In FIG. 8 the foam ball 6 is shown as follows:

(A) shows a perspective view of ball 6 with a plurality of holes 7.

(B) shows a side view of the ball 6 with hole 7.

(C) shows the ball 6 with hole 7, entrance 27 and exit 28.

After the holes are punched into the ball the remaining foam has to be sufficient to allow the ball to be volleyed on the table surface.

As to the preferred manufactured apparatus. A complete model can be sold including table and all the adaptable accessories thereof or a kit may be sold which includes two backboards; two hoop/net assemblies; a virtical game net and all the attachment means. The kit will fit any table tennis table. Just remove the original net with attachment means and install the kit of the present invention. The consumer may use their own table tennis paddles or choose from our selection. The game is better played with the foam game ball of the present invention. Table tennis balls do not combine-Well with the hoops and, nets of the present invention.

It is he understood that the aforementioned detailed form of the preferred embodiment of the invention is not to be limited to the exact arrangement but is an example only. The arrangement of the parts shown in the drawings or described in the disclosure may be modified without departing from the true spirit and scope of the invention. The details of the shape, size, materials and function of the game of the invention are of novel concept thereof.

Having thus described the invention with an exclusive property or privilege:

What I claim is:

1. A table tennis game apparatus comprising;

a table tennis table having a planar horizontally extending playing surface;

a net extending vertically from and transversely across said playing surface to define equal playing areas on each side of said net; means attaching said net to said table;

a pair of planar ball deflection backboards; said backboards being attached to a respective side of said playing surface at amid-point between said equal playing areas and having a planar surface perpendicular to the longitudinal axis of said net;

a hoop attached to each of said backboards at a predetermined elevation above said net and playing surface; each said hoop having a net attached thereto and being dimensioned to receive a game ball;

a game ball and at least one striking instrument for use by a player for striking said game ball to propel it against a said deflection backboard, through a said hoop and into a said net or against a said deflection backboard and into a said playing area.

2. The table tennis apparatus as defined in claim 1 wherein;

said net attached to said hoops has a closed bottom whereby a said game ball is retained after passing through a said hoop.

3. The table tennis apparatus as defined in claim 1 wherein;

said at least one ball striking instrument is a paddle.

4. The table tennis apparatus as defined in claim 1 wherein;

said at least one ball striking instrument is a racket having strings.

5. The table tennis apparatus as defined in claim 1 wherein;

said at least one ball striking instrument is a mitten made from foam material.

6. The table tennis apparatus as defined in claim 1 wherein;

said ball striking instrument is a pair of mittens, one of said mittens being configured to be worn on the right hand of a right handed player and the other of said mittens being configured to be worn on the left hand of a left handed player.

7. The table tennis apparatus as defined in claim 1 wherein;

said ball is made of a foam material and has a diameter in the range of two to four inches.

8. The table tennis apparatus as defined in claim 1 wherein;

said ball has at least one hole extending therethrough.

* * * * *